US006009673A

United States Patent [19]

Adams

[11] Patent Number: 6,009,673

[45] Date of Patent: Jan. 4, 2000

[54] INSULATED MODULAR HUNTING BLIND, ICE FISHING SHELTER AND/OR WILDLIFE OBSERVATORY

[76] Inventor: Edward D. Adams, Rte. 1, Box 12, Livingston, Ala. 35470

[21] Appl. No.: 08/890,123

[22] Filed: Jul. 9, 1997

[51] Int. Cl.[7] ..... E04H 9/16

[52] U.S. Cl. ..... 52/79.1; 135/901

[58] Field of Search ..... 52/79.1, 79.5, 52/79.6, 79.12, 262, 265, 270, 143; 135/901

[56] References Cited

U.S. PATENT DOCUMENTS

| | | | |
|---|---|---|---|
| 4,265,261 | 5/1981 | Barker | 135/93 |
| 4,364,193 | 12/1982 | Visco | 135/98 |
| 5,036,634 | 8/1991 | Lessaro et al. | 52/79.1 |
| 5,210,984 | 5/1993 | Eckel | 52/79.5 |
| 5,724,774 | 3/1998 | Rooney | 52/79.12 |

*Primary Examiner*—Michael Safavi

*Attorney, Agent, or Firm*—Waddey & Patterson; Edward D. Lanquist, Jr.

[57] ABSTRACT

A modular enclosure for use as a hunting blind, an ice fishing shelter, and wildlife observatory or the like. The enclosure comprises a plurality of rigid, insulated panels installed in a frame assembly to form a front wall, a back wall, spaced apart end walls, a roof and a floor. The frame assembly comprises a plurality of track members mounted the roof and the floor, and configured to receive the top and bottom edges of the wall panels. The enclosure further comprises at least one opening or port in the nature of a window, a door, and a plurality of handles mounted to the exterior to facilitate transport of the enclosure. A sun visor is mounted to the exterior of the enclosure above the at least one opening. A bench is mounted in the interior of the enclosure at a position immediately below the at least one opening for supporting a firearm. A storage shelf may also be provided in the interior of the enclosure. Skis may be mounted to the enclosure to facilitate transport of the enclosure over icy surfaces.

10 Claims, 7 Drawing Sheets

INSULATED MODULAR HUNTING BLIND, ICE FISHING SHELTER AND/OR WILDLIFE OBSERVATORY

BACKGROUND OF THE INVENTION

The present invention relates generally to hunting blinds, blinds used as wildlife observatories, and/or ice fishing shelters, and more particularly to such structures that are constructed of insulated modular panels.

Hunters, nature watchers and wildlife photographers have long recognized the need to either camouflage or otherwise conceal their presence when in the habitat of game because game are extremely sensitive to unfamiliar objects and movement. The use of camouflaged clothing and equipment, however, does not effectively conceal the movement that occurs when, for example, a hunter positions his/her rifle, a wildlife observer raises his/her binoculars or a photographer positions his/her camera. Accordingly, blinds or shelters are commonly employed for such purposes, and also to provide some measure of protection from inclement weather, such as snow, rain, wind or cold.

An enclosure or shelter offers many advantages in that it effectively conceals the movement and scent of hunters and others and provides a convenient place to store equipment and other articles associated with the occupant's particular activity.

The art to which the present invention relates includes enclosures for use by hunters, wildlife observers and/or ice fishermen. It will be appreciated by those skilled in the art that it is convenient to have an enclosure capable of concealing the presence and scent of persons who are not a part of the natural habitat and also capable of protecting persons from the effects of weather. To this end, there have been several attempts to devise hunting blinds, ice fishing houses and similar structures which provide protection for the occupants and which are easily transported and assembled.

One such attempt was disclosed in U.S. Pat. No. 3,971,395, issued to Lipinski, which is incorporated by reference as if fully set forth herein. The Lipinski disclosure is directed to a collapsible self-storing shelter having a rigid floor platform to which front and rear walls are swingabe between upright wall-defining positions and lowered storage positions. A plurality of removable longitudinal beams extends between the upright front and rear walls to prevent swinging of the walls toward one another. A plurality of cords extends between the platform and front and rear walls to further retain the walls in upright positions. A weather-resistant canvas tarpaulin is fixed to the front and rear walls and also to the platform to define an integral roof and side walls for the shelter. A pair of skis facilitates transport of the shelter.

U.S. Pat. No. 3,739,536, issued to Ward, which is incorporated by reference as if fully set forth herein, is directed to a knock-down shelter. The shelter includes opposite end walls comprising at least one rigid panel, the lower edges of which are releasably received within a groove at the front and rear of the shelter. A plurality of elongated rail members have L-shaped angle elements at each end which detachably engage over the upper edges of the panels and also the vertical braces secured thereto. A canvas sheet overlies the upper edges of the panels and the rail members to form the top and side walls of the structure. The edges of the canvas are anchored by means of flexible ropes. The floor includes hinged openings.

U.S. Pat. No. 3,018,857, issued to Parham, which is incorporated by reference as if fully set forth herein, is directed to a portable hunting blind having component parts which can be easily assembled or collapsed to a portable package. The blind includes a base, front, back and side panels, and a slidable roof structure and a cooperating movable curtain operable by the hunter to completely camouflage, conceal and/or cover the hunter in a variety of shooting positions.

U.S. Pat. No. 2,546,588, issued to Ellis, which is incorporated by reference as if fully set forth herein, is directed to a Fishing shelter or the like. The Ellis enclosure includes a floor comprising foldable sections, a collapsible frame structure and a canvas tent covering. The shelter is equipped with ice runners to facilitate transport of the shelter over ice.

The list that follows is directed to other hunting blinds, ice fishing shelters and similar enclosures found in the related art.

| Patent No. | Inventor |
|---|---|
| 5,341,588 | Lizotte |
| 5,010,909 | Cleveland |
| 4,938,243 | Foster |
| 4,926,893 | Klopfenstein et al. |
| 4,796,649 | Tolomay |
| 4,794,717 | Horsmann |
| 4,777,755 | Colburn |
| 4,364,193 | Visco |
| 3,826,270 | Hentges |
| 3,690,334 | Miller |

What is needed, then, is an insulated, modular hunting blind or enclosure for concealing at least one person that is easy to assemble yet durable to withstand exposure to inclement weather. This device is presently lacking in the prior art.

SUMMARY OF THE INVENTION

The present invention comprises a portable, modular hunting blind and ice fishing shelter comprising a plurality of insulated panels attached to a frame assembly to form an enclosure. The panels comprise an outer skin covering a core of insulating material. The outer skin may be constructed of metal, such as aluminum, fiberglass, plastics, composites and the like. The insulating material preferably comprises a rigid foam-type insulation, such as styrofoam. However, other suitable insulating materials are also contemplated to be within the scope of the present invention.

It is an object of the present invention to provide a versatile shelter capable of being used as, among other things, a hunting blind, a wildlife observatory or an ice fishing shelter.

It is an object of the present invention to provide a single shelter capable of being used as a hunting blind during fall hunting season and capable of later being easily moved to a frozen lake during ice fishing season, and further capable of being moved to various wildlife habitats for observation or photography after hunting and ice fishing seasons have ended.

It is an object of the present invention to provide a modular enclosure constructed of a plurality of insulated panels installed in a frame assembly designed to eliminate traditional structural supports such as vertical wall studs, joists, and rafters by using floor, wall, and ceiling panels with sufficient strength and rigidity such that framework is required only to secure floor, wall, and ceiling panels together.

It is an object of the present invention to provide a portable enclosure for use in the outdoors, the enclosure having a front wall, a back wall, spaced apart end walls, a roof, a floor and a plurality of windows or ports configured to accommodate a firearm extended therethrough.

It is an object of the present invention to provide a rigid weatherproof enclosure having a firearm bench rest mounted therein below any of the plurality of windows for enabling a hunter to rest a firearm thereon.

It is an object of the present invention to provide a shelter having skis enabling the shelter to be transported over a frozen body of water, and a trap door in the floor enabling the shelter to function as an ice fishing house by positioning the shelter over a hole in the ice such that the trap door opens over the hole.

It is an object of the present invention to provide a shelter constructed of corrosion-resistant and rot-proof materials for eliminating the maintenance and replacement that result from exposure to the elements.

It is an object of the present invention to provide a shelter which is sealed to prevent access by dangerous spiders, wasps, rodents, and other pests when unoccupied.

It is an object of the present invention to provide a safe, comfortable shelter which will accommodate overnight use by hunters and wildlife observers in order to avoid disturbing wildlife by entering the hunting or observation area before daylight.

It is an object of the present invention to provide a shelter for hunters, wildlife observers, and other persons who must avoid exposure to inclement weather.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1:
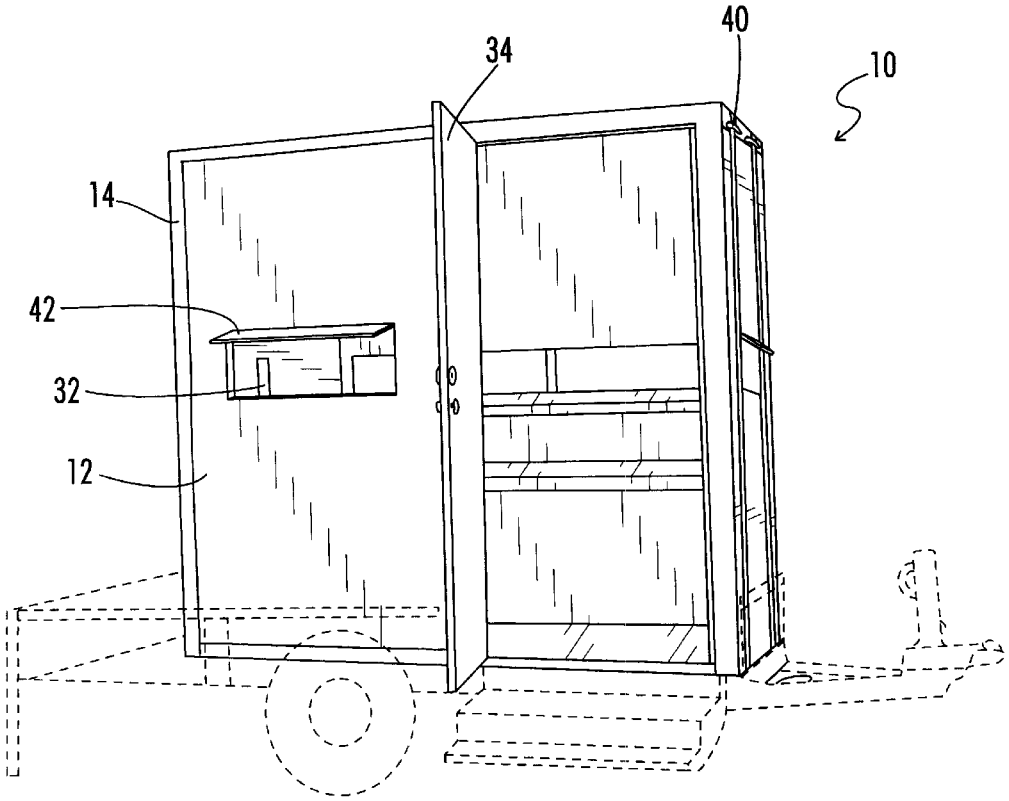
FIG. 1 is rear perspective view of an embodiment of the present invention.

An embodiment of the present invention is designated generally by the reference numeral 10 in FIG. 1. The enclosure 10 comprises a plurality of panels 12 installed in a frame assembly 14 to form a front wall 16, a back wall 18, spaced apart end walls 20 and 22, a floor 24 and a roof 26 (see FIGS. 3–6).

Figure 2:
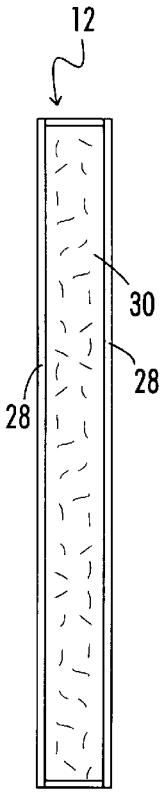
FIG. 2 is a representational side view of the preferred configuration of a typical panel of the present invention.

With reference to FIG. 2, each panel 12 comprises an outer skin 28 covering a core 30 formed of insulating material. In the preferred embodiment, the outer skin 28 is constructed of a lightweight material, such as aluminum. The core 30 of each panel 12 preferably comprises expanded polystyrene, but may comprise any other suitable insulating material. The outer skin 28 may be laminated, bonded by adhesive or attached in some other suitable manner to the core 30 such that the outer skin 28 encapsulates the core 30.

The modular panels 12 may be erected in the frame assembly 14 to form a variety of configurations to suit the user's needs. For example, the enclosure may be configured as a hunting blind, an ice fishing shelter or a wildlife observatory, or a combination of any or all of these. Accordingly, the enclosure 10 may include a plurality of openings in the nature of windows or ports 32, doors 34 and the like to accommodate the requirements of the activity for which the enclosure 10 is used (see FIGS. 3–5). At least one window 32 may be installed in any of the walls to enable the occupants of the enclosure 10 to view game or wildlife. The at least one window is preferably operably between an open and a closed position to enable a hunter, for example, to extend a firearm therethrough. In the preferred embodiment, at least one door 34 is provided for enabling ingress and egress from the enclosure 10.

The enclosure 10 depicted in the figures is configured to be used as a hunting blind. However, it is recognized that openings for windows 32, doors 34 and the like may be located at any desirable location due to the modular nature of the enclosure 10. Thus, to accommodate the use of the enclosure 10 as an ice fishing shelter, a hinged access door 36 may be provided in the floor 24 to enable the occupants to access a hole 35 in the ice (see FIGS. 7–8). A latch device 37 may be provided to retain the access door 36 in an open position. Further, skis 39 may be attached to the frame assembly 14 to facilitate transport of the enclosure 10 across any icy surface. The skis 39 may be removed when the enclosure 10 is moved from a frozen body of water and transported to another area to be used in a different manner.

With reference to FIGS. 3–6 and FIG. 9B, the frame assembly 14 of the present invention comprises a plurality of track members 38 mounted to the floor 24 and roof 26 panels and configured to receive edge portions of the front wall 16, back wall 18, and end walls 20 and 22. Each of the track members 38 preferably comprises a substantially L-shaped aluminum extrusion positioned along abutting edges of adjacent panels 12. In this manner, a first leg 40 of track member 38 overlaps roof panel 26 along its outer periphery. A second leg 42 of track member 38 overlaps an edge 44 of roof panel 26 and a portion of the outer periphery of the front wall 16, the back wall 18 and the end walls 20 and 22. Similarly, a first leg 40 of track member 38 overlaps floor panel 24 along its outer periphery. A second leg 42 of track member 38 overlaps an edge 46 of floor panel 24 and a portion of the outer periphery of front wall 16, the back wall 18 and the end walls 20 and 22. Track members 38 may also be installed along the vertical corners where adjacent wall panels 12 are joined.

Figure 3:
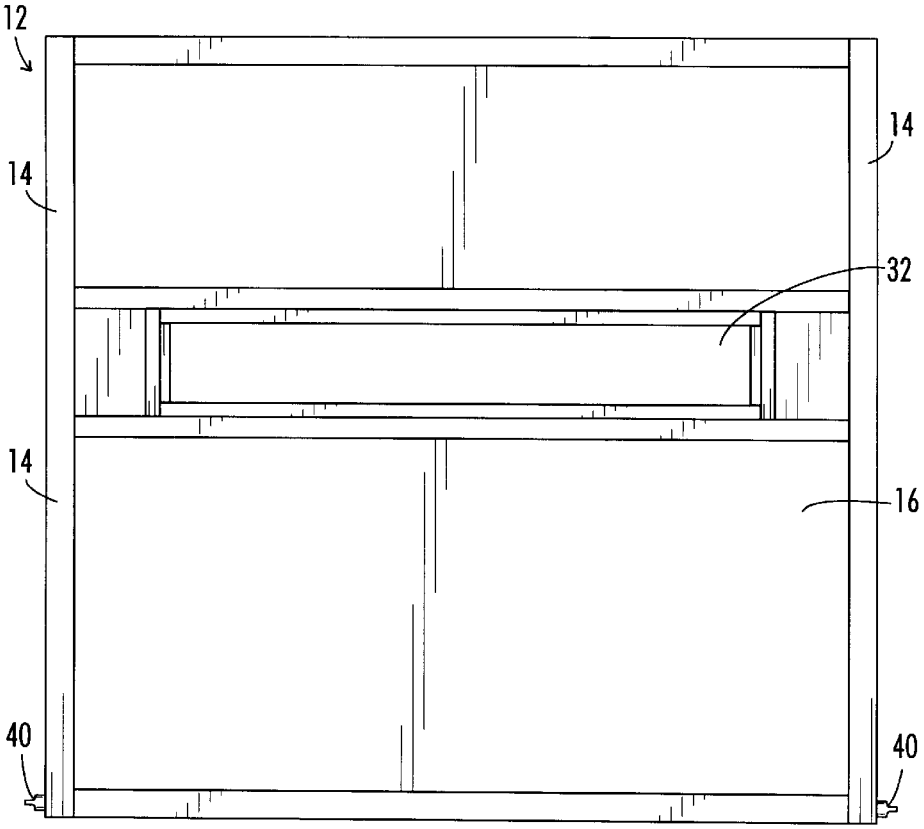
FIG. 3 is a front view of the embodiment of the invention shown in FIG. 1.
Figure 4:
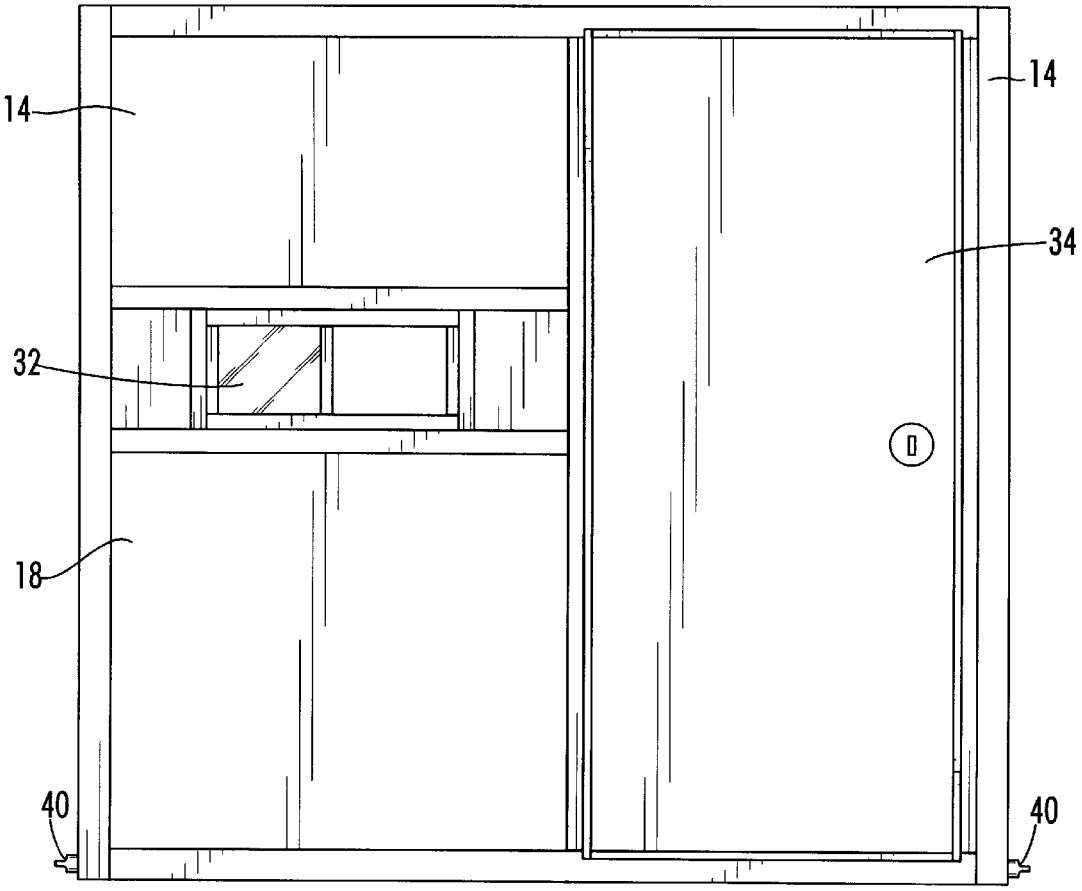
FIG. 4 is a rear view of the embodiment of the invention shown in FIG. 1.
Figure 5:
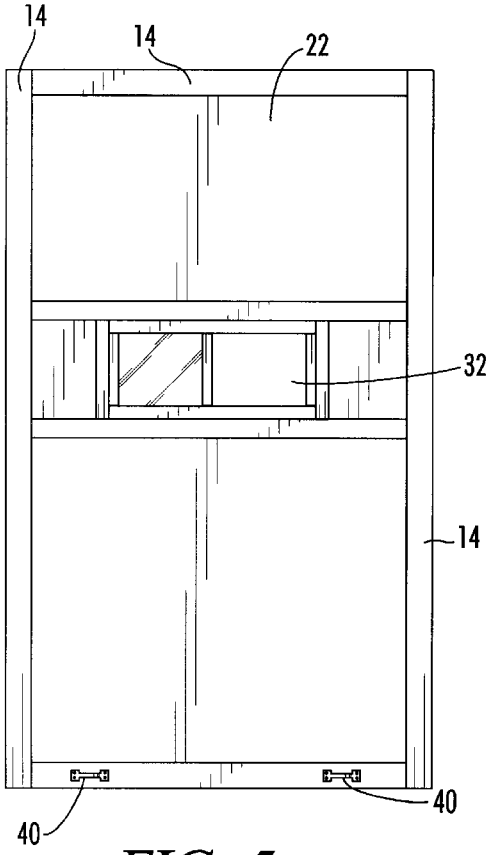
FIG. 5 is a end view of the embodiment of the invention shown in FIG. 1.
Figure 6:
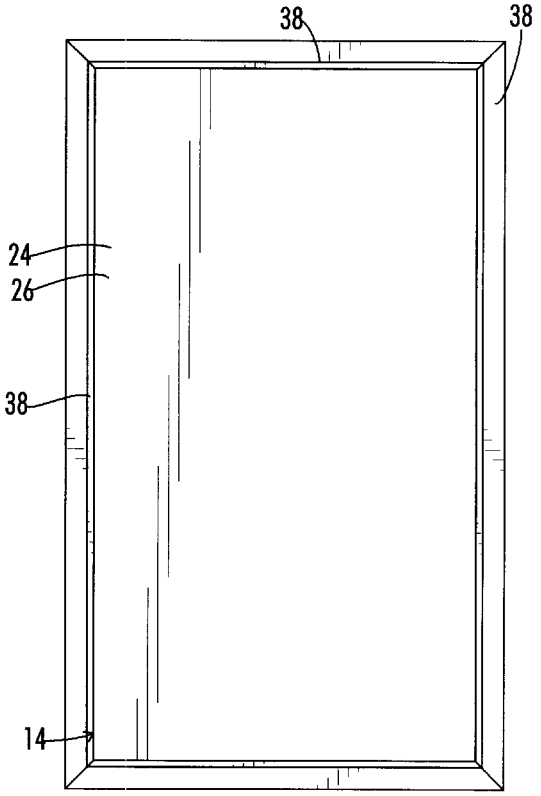
FIG. 6 is a plan view of the panel used to form the floor and roof of the enclosure of the invention shown in FIG. 1.

The frame assembly 14 may further include a substantially H-shaped channel 48 (see FIG. 9B) for installation at the planar intersection of adjacent panels as shown in FIGS. 3–5. The channel 48 enables the user to position the panels 12 in a variety of configurations by providing a means for adjoining adjacent panels 12. Thus, if the user desires to install a window 32 in the enclosure 10, the periphery of the window 32 may be inserted into one side of the channel 48 and the edge of the adjacent panel 12 may be installed in the opposing side of the channel 48.

The panels 12 may be secured to the frame assembly 14 by any suitable fastening means, including without limitation adhesive caulking, screws or fasteners. The ends of each track member 38 may be mitered at the point at which adjacent When assembled, the enclosure 10 provides an insulated, airtight shelter. The insulative properties of the panels 12 enable the occupants of the enclosure 10 to maintain a desired degree of comfort even in extreme cold temperatures without the need for a heating device such as a combustion heater, which may generate harmful fumes. Furthermore, because the insulating material 31 in the core 30 of the panels 12 attenuates sound, game or wildlife are unable to detect sound generated within the enclosure 10.

The exterior of the enclosure 10 is preferably camouflaged to blend in with the surroundings. Lift handles 50 may be mounted to the frame assembly 14 to facilitate transport of the enclosure 10 (FIGS. 3–5). Sun shades or visors 52 may be mounted over the window opening(s) 32 on the exterior of the enclosure 10 to shield the occupants from glare of the sun (FIG. 1). Further, the window openings 32 may be covered with a material, such as a camouflage mesh or other suitable material 54, which enables an occupant to view objects outside of the enclosure, but which obscures the view into the enclosure so that game or other persons may not see inside the enclosure.

Figure 7:
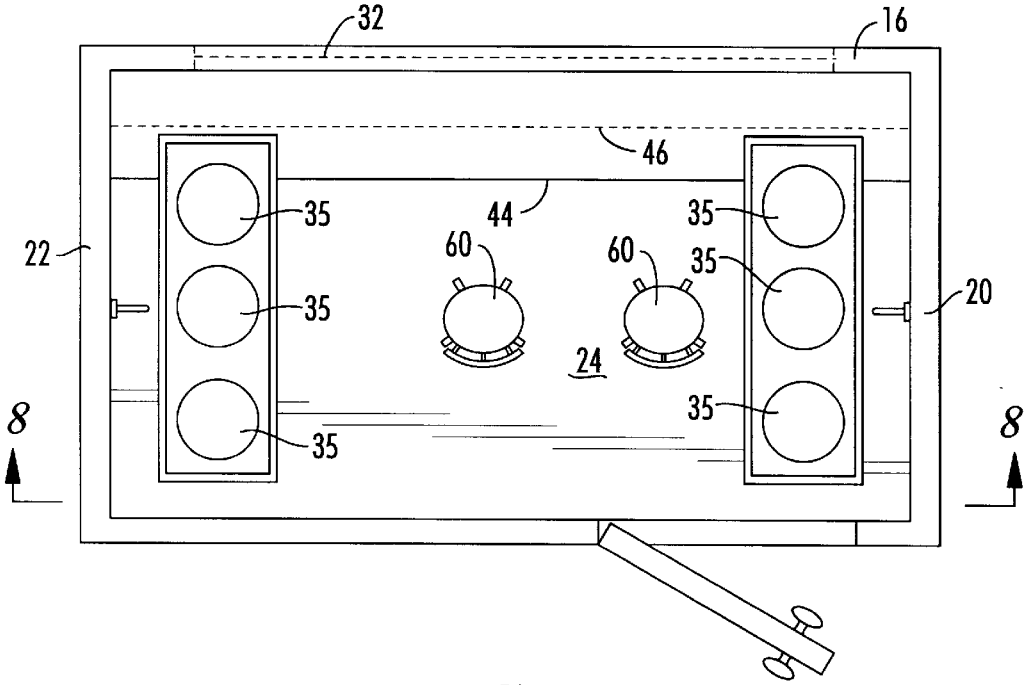
FIG. 7 is a plan view of the enclosure of the present invention.
Figure 8:
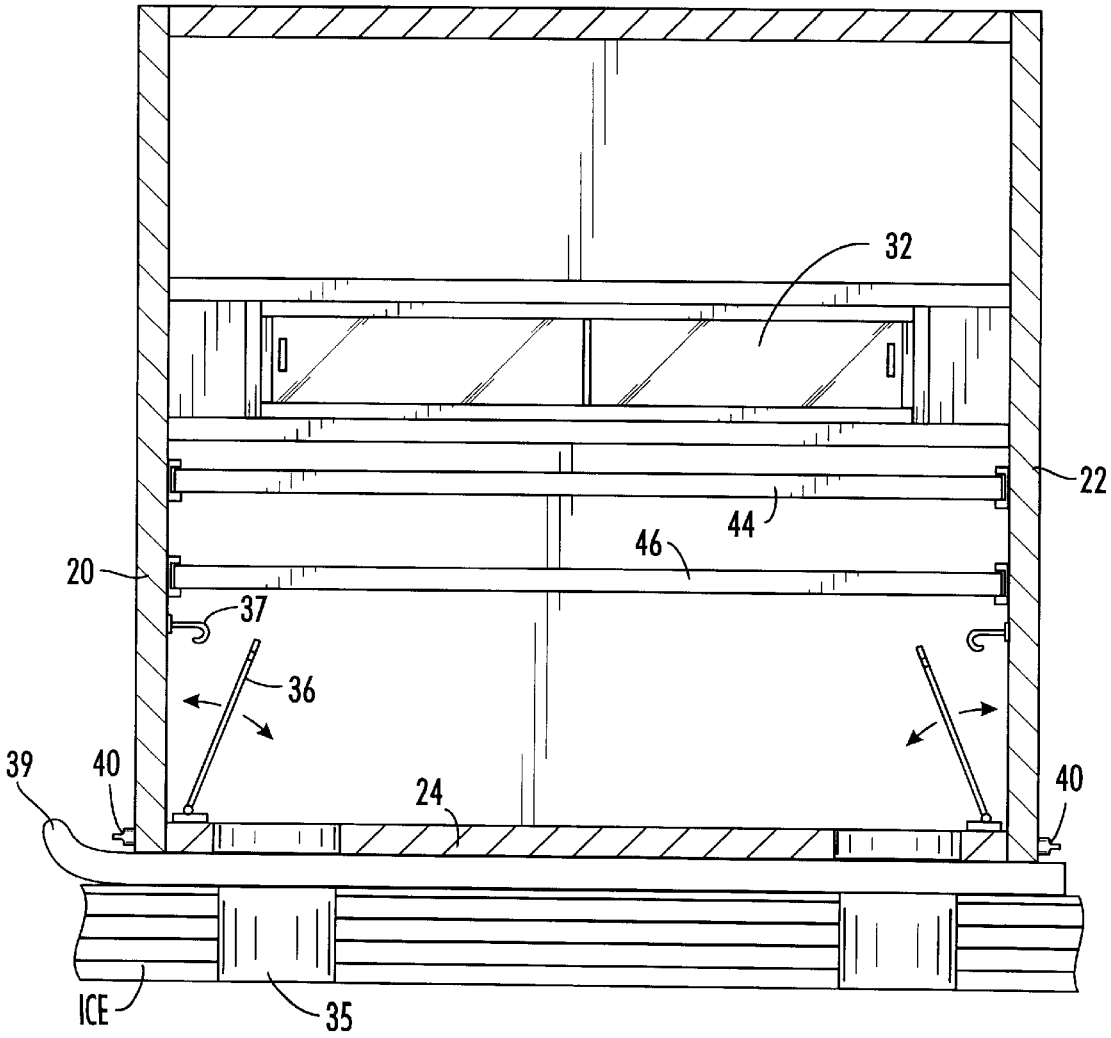
FIG. 8 is a front sectional view of the enclosure of the present invention taken along lines 8—8 of FIG. 7.
Figure 9A:
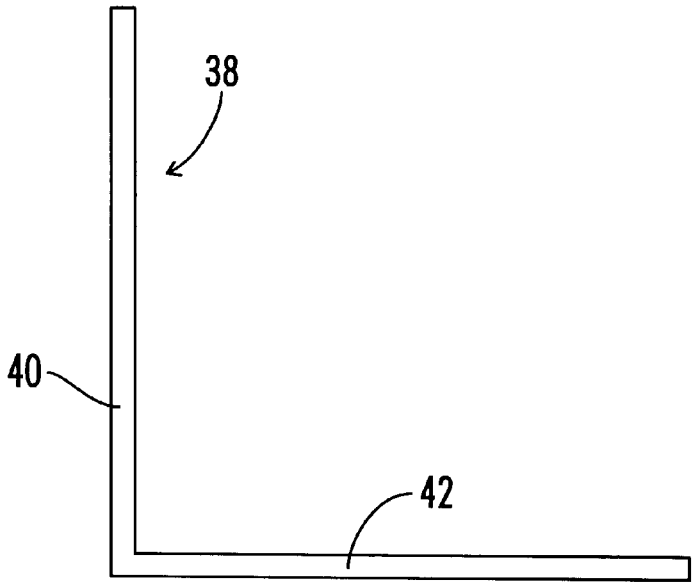
FIG. 9A is an end view of a track member of the frame assembly of the present invention.
Figure 9B:
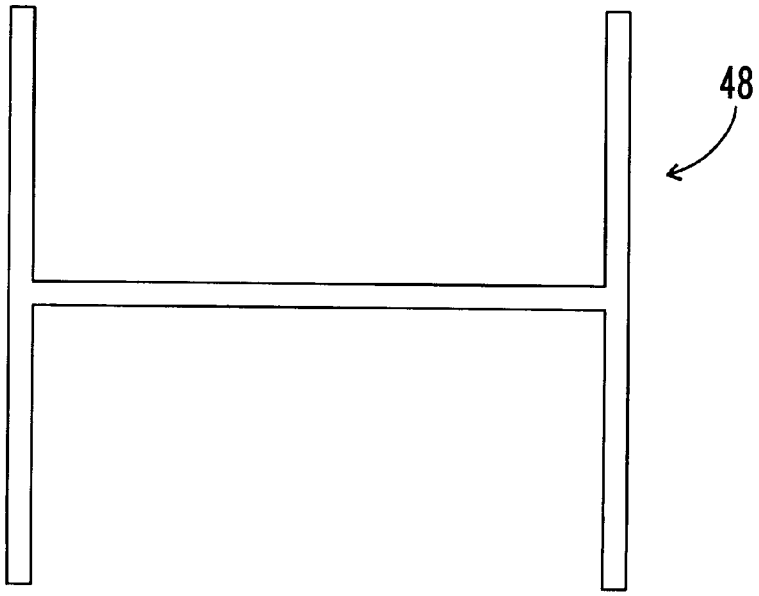
FIG. 9B is an end view of the channel member of the frame assembly of the present invention.

The interior of the enclosure 10 may also be customized to include a shooting bench 56, at least one storage shelve 58, chairs 60 and the like (FIGS. 7–8). In the preferred embodiment, the bench 56 is mounted to the interior surface of the enclosure 10 immediately below the window(s) 32 to enable a hunter to support a firearm thereon. The at least one storage shelf 58 is preferably mounted below the shooting bench 56, but may be positioned at any desired location within the enclosure 10.

Thus, although there have been described particular embodiments of the present invention of a new and useful modular, insulated enclosure, it is not intended that such references be construed as limitations upon the scope of this invention except as set forth in the following claims. Further, any dimensions used in the preferred embodiment are not intended to be construed as limitations upon the scope of this invention except as set forth in the following claims.

What I claim is:

1. A modular enclosure for use as a hunting blind, comprising:

a plurality of rigid panels assembled in a frame to form a generally rectangular structure having a front wall, a back wall, spaced apart end walls, a floor and a roof;

wherein at least one of the plurality of panels includes a rigid lockable door for enabling a user to enter and exit the enclosure;

wherein the frame includes a plurality of track members mounted to the floor and configured to receive a bottom edge of each of the wall panels, and a plurality of track members mounted to the roof and configured to receive a top edge of each of the wall panels;

wherein each of the plurality of panels comprises a metallic outer skin encapsulating a core comprising expanded polystyrene;

at least one lockable window slidable between an open and a closed position;

a sun shade mounted on an exterior of the enclosure over the at least one window;

a firearm support bench mounted in the interior of the enclosure immediately below the at least one window;

a storage shelf mounted in the interior of the enclosure; and a plurality of lift handles mounted to the frame to facilitate transport of the enclosure.

2. The enclosure of claim 1, further comprising:

skis removably mounted to the enclosure for facilitating transport across an icy surface.

3. A modular enclosure for use as a hunting blind, comprising:

a plurality of rigid panels assembled in a frame to form a front wall, a back wall, spaced apart end walls, a floor and a roof;

wherein at least one of the plurality of panels includes a door for enabling a user to enter and exit the enclosure;

wherein the frame includes a plurality of track members mounted to the floor and configured to receive a bottom edge of each of the wall panels, and a plurality of track members mounted to the roof and configured to receive a top edge of each of the wall panels;

wherein each of the plurality of panels comprises an outer skin encapsulating a core comprising an insulating material;

at least one opening positioned intermediate a top and a bottom of any of the plurality of panels;

a plurality of lift handles mounted to the frame to facilitate transport of the enclosure; and at least one hinged door formed in the floor.

4. The enclosure of claim 3, wherein the outer skin is constructed of aluminum.

5. The enclosure of claim 3, wherein the core comprises expanded polystyrene.

6. The enclosure of claim 3 wherein the at least one opening further comprises:

at least one lockable window operable between an open and a closed position.

7. The enclosure of claim 3 wherein the at least one opening is covered with a material which obscures the view into the enclosure from a position outside of the enclosure but which enables a person to view objects outside of the enclosure from a position inside the enclosure.

8. The enclosure of claim 6, further comprising:

a sun shade mounted on an exterior of the enclosure over the at least one window.

9. The enclosure of claim 6, further including:

a firearm support bench mounted in the interior of the enclosure immediately below the at least one window.

10. The enclosure of claim 3, further comprising:

a storage shelf mounted in the interior of the enclosure.

* * * * *